US005133245A

United States Patent [19]

Lee et al.

[11] Patent Number: 5,133,245

[45] Date of Patent: Jul. 28, 1992

[54] CONTINUOUSLY ADJUSTABLE STROKE LIMITER FOR HYDRAULIC POSITIONER

[75] Inventors: Jimmy C. Lee, Northridge; Calvin R. Stringer, Saugus, both of Calif.

[73] Assignee: P. L. Porter Company, Woodland Hills, Calif.

[21] Appl. No.: 694,221

[22] Filed: Apr. 12, 1991

[51] Int. Cl.[5] ..... F15B 15/24

[52] U.S. Cl. ..... 92/13.4; 92/13.7

[58] Field of Search ..... 92/13.4, 13.7, 13.8; 188/285, 266; 267/64.11

[56] References Cited

U.S. PATENT DOCUMENTS 3,177,980 4/1965 Porter ..... 92/13.8
3,407,710 10/1968 Weiss ..... 92/13.8
3,760,911 9/1973 Porter et al. ..... 92/13.4
3,968,735 7/1976 Boisde et al. ..... 92/13.8

*Primary Examiner*—Edward K. Look
*Assistant Examiner*—F. Daniel Lopez
*Attorney, Agent, or Firm*—Beehler & Pavitt

[57] ABSTRACT

The stroke length in a positioner of the type having a piston rod movable through a cylinder can be preset through a continuous range of adjustment. A first detent element provided at the end of the cylinder engages another detent element positionable along the rod to limit stroke length. Spacing between the two detents is continuously adjustable by rotation of a threaded sleeve coaxial with the rod. Once installed in a recliner seat or the like, the device is secure against accidental changes in the stroke setting.

14 Claims, 3 Drawing Sheets

CONTINUOUSLY ADJUSTABLE STROKE LIMITER FOR HYDRAULIC POSITIONER

BACKGROUND OF THE INVENTION

1. Field of the Invention

The present invention relates generally to the field of hydraulic mechanical positioning devices such as those used for positioning the back rest of a reclining seat, and more particularly pertaining to an improved such device which allows presetting of a mechanical stop for positively limiting the length of the stroke of the positioning device.

2. State of the Prior Art

Positioning devices, in particular hydraulic positioners, have been in used for a long time and have found widespread application in recliner seats for controlling the angle of the reclining back rest to suit the preference of a seat occupant. Such hydraulic positioners are used in passenger seats on commercial airliners, where the back rest of the passenger seat is movable between a fully upright position and a more comfortable reclining position. The maximum permissible reclining angle of the back rest for a particular seat depends, among other factors, on the spacing between successive seat rows in an aircraft as well as the location of a particular seat within the aircraft. Seats adjacent to an aircraft exit, for example, may require limitation of the maximum depression of the back rest to assure adequate clearance at all times for safe passage. Seats of similar design in a particular aircraft may therefore require different limits to the recliner adjustment depending on the location on a particular seat in the aircraft. Similar considerations may apply to recliner seat installations in other vehicles, such as automotive applications.

Many recliner seat designs are known in which the angle of the reclining back rest is adjustable by means of one or more positioners such as the positioner disclosed in U.S. Pat. No. 3,860,098, issued Jan. 14, 1975 and owned by this applicant. These positioners are hydraulic devices where a rod is connected to a piston displaceable within a cylinder containing a hydraulic fluid. A valve controls fluid flow between two chambers in the cylinder. The valve is actuatable by a control typically mounted on the arm rest of the recliner seat and accessible to the seat occupant. In a normal condition of the device the valve is closed, preventing fluid flow between the two chambers and consequently locking the piston against movement relative to the cylinder. In this normal condition of the device, the rod is fixed against movement through the cylinder and the back rest is fixed in a selected position. If the occupant desires to readjust the position of the back rest, he or she actuates the valve control, opening the valve to fluid flow and permitting the rod and piston to move axially along the cylinder to a new position In the usual installation, an external coil spring of substantial size is mounted coaxially with the cylinder and compressed between the cylinder and rod, biasing the device to an extended position which usually corresponds to a fully upright position of the recliner back rest. The seat occupant repositions the back rest by first actuating the valve to an open position and then pushing backwards on the back rest to drive the rod into the cylinder against the bias of the external spring, then releasing the valve control to its normal, closed position, to lock the seat back rest at the selected new angle. The positioner is consequently adjustable through a stroke of the rod relative to the cylinder, between a fully extended and a retracted condition. In order to limit the maximum angle of depression of the recliner back rest, it is necessary to limit movement of the rod into the cylinder to stop the stroke short of the fully retracted condition otherwise possible in the particular positioner.

In the past, such limitation has called for use of customized mechanical stops in such positioners, dimensioned to meet the requirements of each particular seat installation.

A need exists for a positioning device with an integral, continuously adjustable stroke limiter, such that a stroke limit for each positioner can be easily and quickly preset at any point within a given maximum stroke of the positioner, without necessity for custom components. Such a positioner with continuously adjustable stroke limiting should be durable, dependable and of economical construction.

SUMMARY OF THE INVENTION

The aforementioned needs are addressed by the improved positioner of this invention. The positioner is of a type having a piston rod movable through a cylinder for adjusting the relative positions of structural elements, such as recliner seat elements, attached to each of the rod and the cylinder respectively. According to this improvement, a first stop element is provided on the cylinder, a second stop element is provided on the rod, the stop elements being configured for limiting the stroke of the rod through the cylinder between a fully extended position of the rod and stopping engagement between the two stop elements. One of the stop elements is axially movable relative to both the cylinder and the rod for adjusting the length of the stroke of the positioner. A sleeve is mounted coaxially to the rod. The sleeve is axially fixed to the rod but rotatable in relation to the rod. The length of the positioner stroke is set by rotating the sleeve about the rod so as to reposition the movable stop element, thereby adjusting the point at which stopping engagement occurs between the two stop elements. In a preferred form of the invention, the sleeve is normally locked to the rod against rotation to thereby fix the length of the stroke, once the second stop element has been positioned.

More particularly, the improved device may include an inner sleeve coaxially fixed to the rod and having an open end for receiving an end of the cylinder, the second stop element being threaded for axial displacement along the inner sleeve and configured to make axial interference with the first stop element on the cylinder to limit travel of the cylinder into the inner sleeve, thereby limiting the stroke length of the positioner. An outer sleeve may be fixed to the rod and interlocked for rotation with the second stop element, which can be repositioned along the inner sleeve by turning the outer sleeve to establish a desired length of the positioner stroke from a fully extended position to stopping engagement between the first and second stop elements. The improved device may also be equipped for locking the outer sleeve against rotation to the rod, thus fixing the second stop element against displacement along the inner sleeve to hold the stroke length setting against accidental alteration, especially in applications where the device may be subject to shock and vibration. In a preferred form of the improved positioner, the first stop element has one or more radial tabs projecting at one end of the cylinder, and the inner sleeve is slotted for admitting the radial tabs as the cylinder end moves through the inner sleeve. The second stop element may be a detent ring on the inner sleeve which stops the radial tabs projecting to the exterior of the inner sleeve through the longitudinal slots, to limit travel of the cylinder end through the inner sleeve, thus limiting the stroke of the positioner at a point short of the maximum retraction of the rod within the cylinder. The point at which this stopping engagement occurs is continuously selectable by moving the detent ring along the inner sleeve. This movement is conveniently accomplished by turning the outer sleeve in relation to the inner sleeve. The detent ring on the inner sleeve may include a radial indicator tab projecting into a slot in the outer sleeve, locking the outer sleeve for rotation with the ring and also providing an exterior visual indication of the position of the detent ring along the slot. A scale may be applied on the outer sleeve graduated to indicate the stroke length corresponding to various positions of the indicator tab.

These other features and advantages of the improved positioner according to this invention will be more readily understood by reference of the following detailed description of the preferred embodiment and the accompanying drawings.

DETAILED DESCRIPTION OF THE PREFERRED EMBODIMENT

Figure 1:
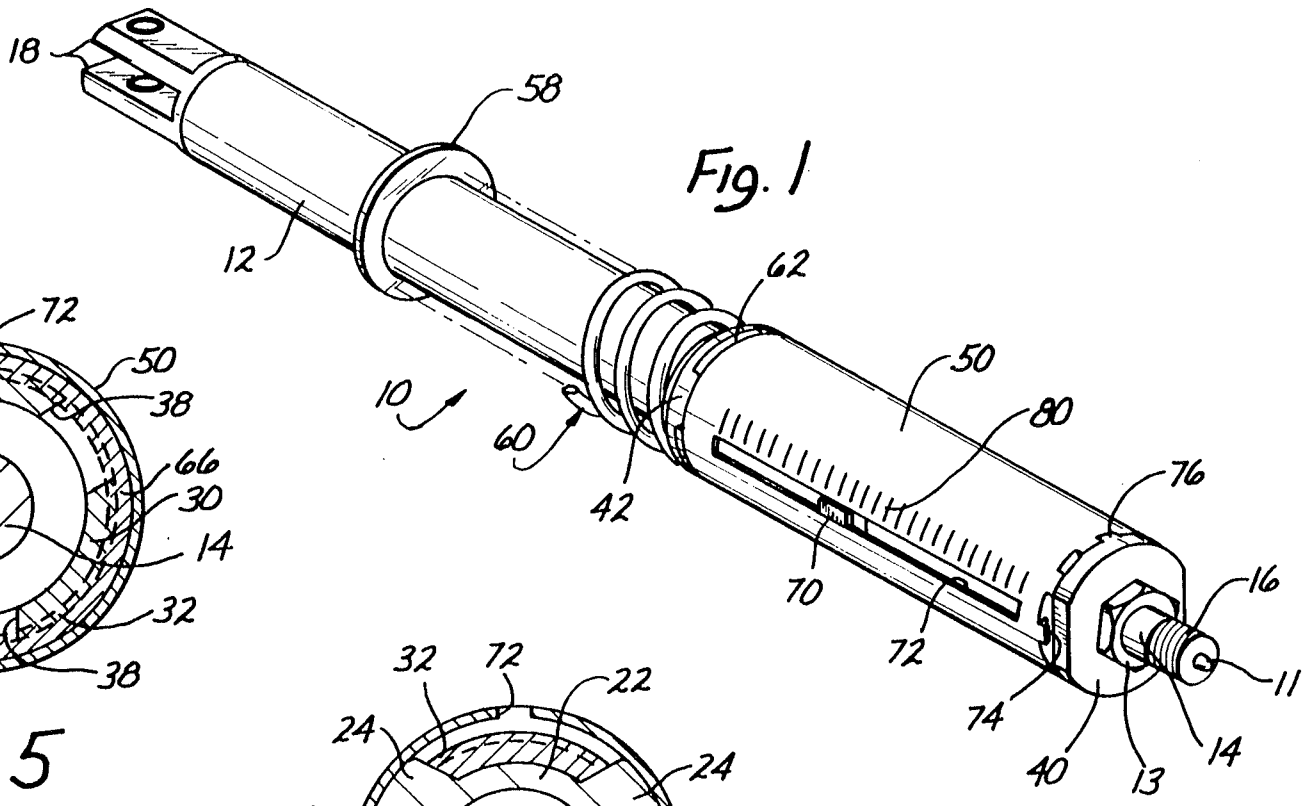
FIG. 1 is a perspective view of a hydraulic positioner improved according to this invention.

With reference to the attached drawings, FIG. 1 shows a hydraulic positioner 10 which has been improved according for the present invention. The positioner 10 has a cylinder 12 and a rod 14 connected to a piston within the cylinder 12. The details of the construction and operation of the piston assembly within the cylinder 12 are not shown, as similar hydraulic positioners are commercially available and their operation is known in the art. For purposes of explanation of this invention, it is sufficient to understand that the rod 14 is movable in an axial direction into and out of the cylinder 12 between a fully extended position and a retracted position. The cylinder and the rod are connected to corresponding structural portions of the recliner seat by means by threading 16 on the rod and perforated end tabs 18 extending from the free end of the cylinder 12, respectively. The positioner is normally in a locked condition in which the rod 14 is fixed positioner 10 is released from this locked condition by actuation of an end pin 11 which extends from the end of the rod 14. This actuation is accomplished by a remote actuator device, such as a Bowden cable actuator, or the like. The rod end of the positioner is connected to an element of the seat mechanism in an interference fit between the end fitting 40 and nut 13, both of which are engaged on thread 16.

Figure 6:
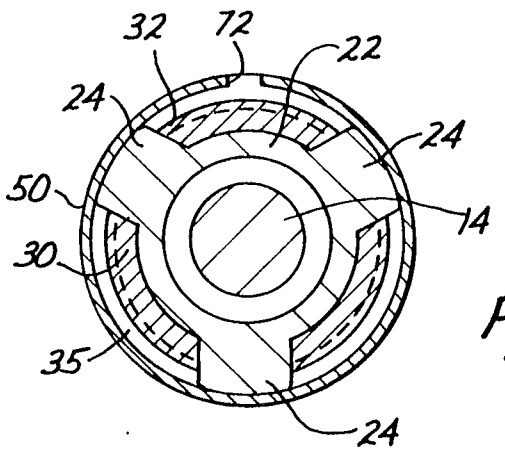
FIG. 6 is a cross sectional view taken along line 6—6 in FIG. 3.
Figure 2:
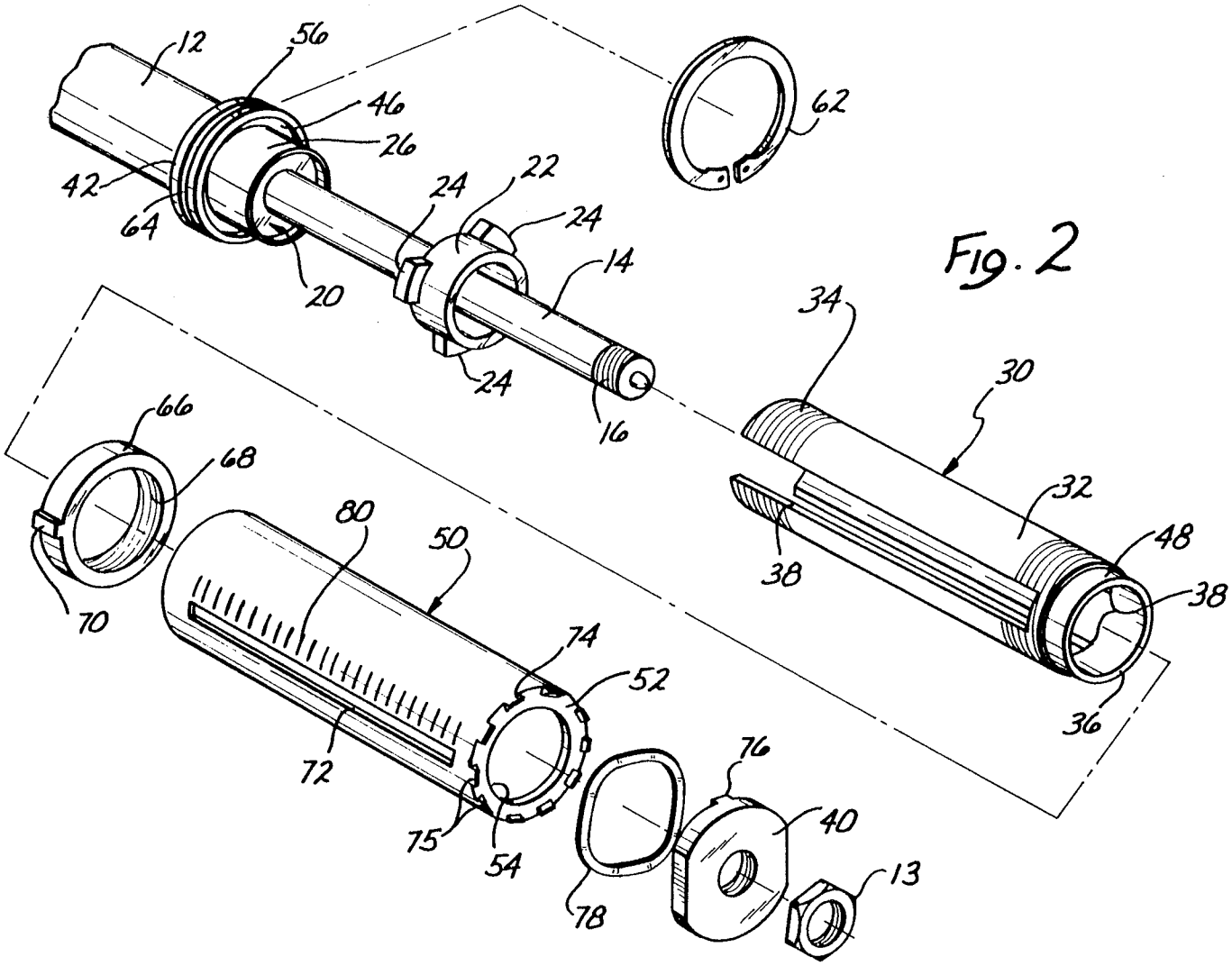
FIG. 2 is an axially exploded view of the stroke limiting assembly mounted on the hydraulic positioner.
Figure 3:
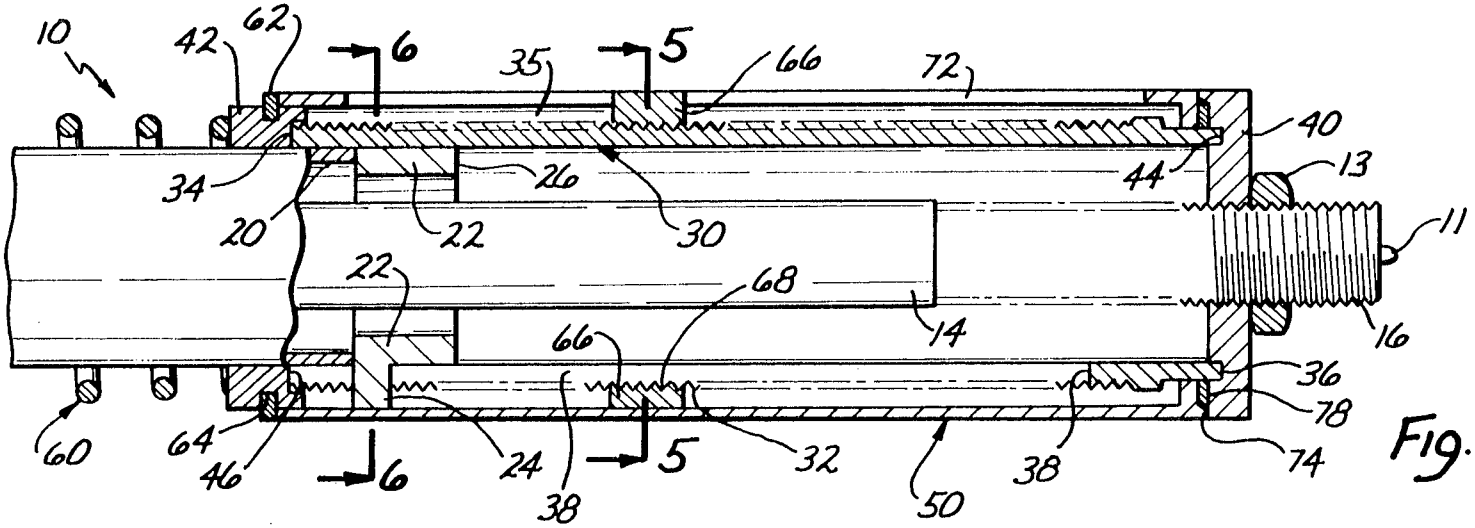
FIG. 3 is a longitudinal section of the stroke limiting assembly showing the positioner in a fully extended condition.
Figure 4:
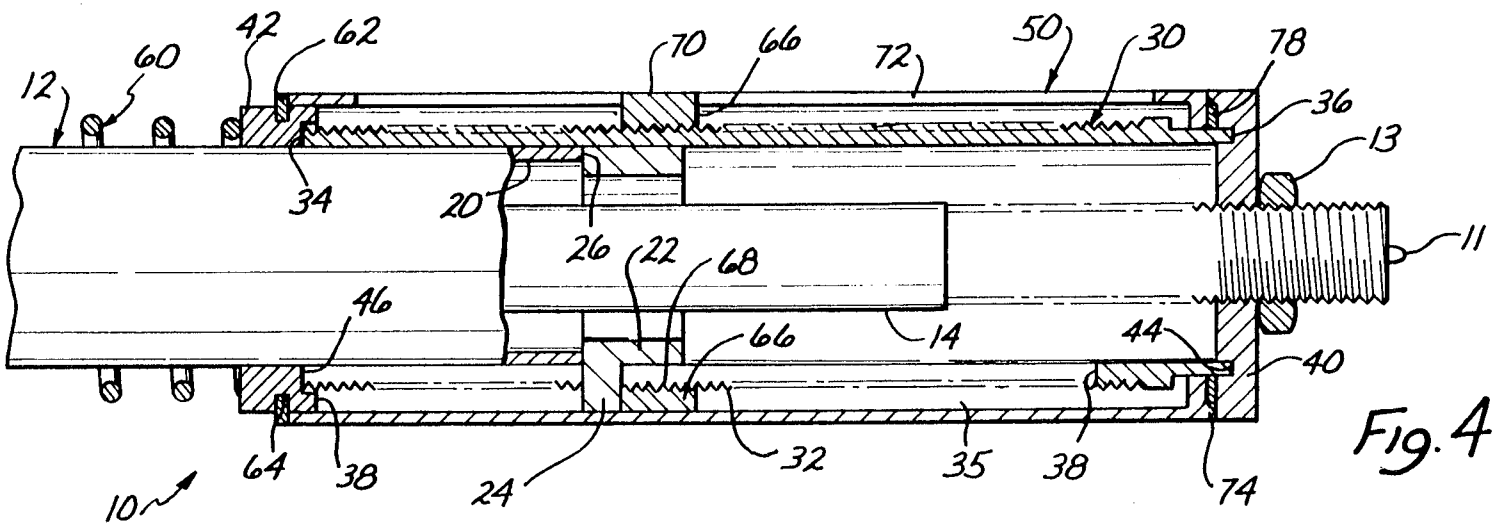
FIG. 4 is a longitudinal section view as in FIG. 3, showing the positioner in a retracted condition limited by stopping engagement between the radial tabs on the cylinder end with the movable detent ring on the inner sleeve.

Turning to FIG. 2 the inner end 20 of the cylinder 1 abuts against a first detent ring 22 which is slidable on the rod 14 and which has three circumferentially spaced radial tabs 24 as illustrated in FIGS. 3 and 4. A cylindrical inner sleeve 30 has a threaded outer surface 32 extending between an inner end 34 and an outer end 36. Three longitudinal slots 38 extend the length of the threaded surface 32 and are open at the inner end 34 of the sleeve. The circumferential spacing and width of the slots 38 is such as to receive the three radial tabs 24 of the first detent ring 22, as shown in FIG. 6, so that the sleeve 30 can telescope axially with the cylinder 12.

The inside diameter of the inner sleeve 30 makes telescoping sliding contact with the cylinder 12 and its opposite end 36 is supported in coaxial relationship with both the rod 14 and cylinder 12 by an end fitting 40 threaded onto the rod 14. The outer end 36 of the inner sleeve 30 mates into a circular groove 44 in the end fitting 40, while the inner end 34 fits into an annular shoulder 46 in an end bushing 42 which is slidable on the cylinder 12.

A cylindrical outer sleeve 50 is supported coaxially to the rod 14 and inner sleeve 30 by end flange 52 which defines an end opening 54 sized to fit closely on the end shoulder 48 of the inner sleeve, as seen in FIGS. 3 and 4. The opposite end of the outer sleeve 50 fits onto the outer surface 56 of the end bushing 42.

A coil spring 60 is compressed between a radial flange 58 (shown in FIG. 1) and the sliding end bushing 42. The spring 60 applies an axial load to the inner sleeve 30 through the bushing 42, urging the end 36 of the sleeve against end fitting 40 which is axially fixed on thread 16 of rod 14. The axial load of spring 60 is likewise transmitted to outer sleeve 50 through a split ring 62 held in a radial keyway 64 defined in the bushing 42, urging both sleeves 30 and 50 against the end fitting 40 and biasing the cylinder 12 and rod 40 to a telescopically fully extended condition shown in FIG. 3: In a recliner seat, this extended condition of the positioner 10 typically corresponds to a fully upright position of the recliner backrest. The spring 60 applies a load of some 120 lbs which holds the inner sleeve 30 against rotation due to frictional engagement of sleeve end 36 in groove 44.

Figure 5:
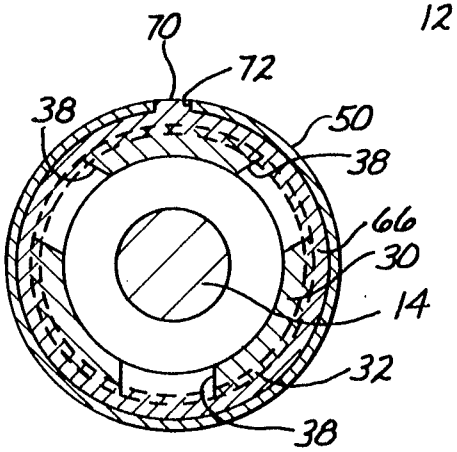
FIG. 5 is a cross sectional view taken along line 5—5 in FIG. 3.

A second detent ring 66 has an interior thread 68 engageable with the exterior thread 32 of the inner sleeve 30. The second detent ring 66 is axially displaceable along thread 32 in a cylindrical space 35 defined between the inner and outer sleeves 30, 50 as shown in FIGS. 3 and 4. A radial tab 70 on the second detent ring 66 projects into a longitudinal slot 72 in the outer sleeve 50 as seen in FIGS. 1,3 and 5, and interlocks the ring 66 in a circumferential direction for rotation with the outer sleeve. The second detent ring 66 can be displaced axially along inner sleeve 30 by rotating the outer sleeve 50 in relation to the fixed inner sleeve 30. In the assembled device, axial displacement of the detent ring 66 is visually indicated by movement of the tab 70 along the length of slot 72. The ring 66 is in axial interference with the radial tabs 24 of the first detent ring 22 as best understood by reference to FIGS. 5 and 6. These tabs project through the slots 38 in the inner sleeve to a radial length greater than the inside dimension of the second detent ring 66. The axial position of the second detent ring 66 along the inner sleeve 30 thus defines a stop which positively limits the distance by which the rod 14 can be telescoped into the cylinder 12. When the first detent ring 22, at the end of cylinder 12, makes contact with the second detent ring 66 on the inner sleeve, stopping engagement occurs between the two detent rings, a condition illustrated in FIG. 4. When such engagement occurs, no further travel of the rod 14 is possible into the cylinder 12, thus limiting the stroke of the positioner 10 to the distance traveled by cylinder end 20 from the extended position of FIG. 3 to the stop position of FIG. 4. The length of the stroke can be continuously adjusted, up to the maximum stroke possible for the particular positioner 10, by repositioning the ring 66 along the thread 32. For example, the stroke length is increased by moving the second ring 66 to the right in FIG. 4, by turning the outer sleeve 50 as has been described. The maximum stroke length possible for the positioner 10 occurs when ring 66 is at the end of thread 32 adjacent to the outer end 36 of the inner sleeve.

The outer sleeve 50 has a notched end 74, best seen in FIG. 2, which interlocks with a detent 76 on the end fitting 40 A spring washer 78 interposed between the end fitting 40 and sleeve 50 urges sleeve 50 away from the detent 76. The stroke limit of the positioner 10 is set by rotating the outer sleeve 50 to position the second detent ring 66 at a selected point along the threaded inner sleeve 30, prior to setting the split ring 62 in the keyway 64. A scale 80 graduated in suitable increments may be applied along slot 72 to facilitate quick and easy setting of the stroke length by aligning the indicator tab 70 with a graduation line corresponding to a desired stroke length. Once the split ring 62 is set in its keyway, the axial load of spring 62 will keep the outer sleeve in positive engagement with the detent 76, fixing the stroke length of the positioner against accidental readjustment until the ring 66 is again removed. The end 74 of sleeve 50 can be provided, for example, with twelve annularly spaced notches 75 each engageable with the detent 76. In combination with a 1/10th inch thread 32, the stroke length of the positioner 10 can be adjusted to a linear resolution of approximately 0.008 inches, providing for practical purposes essentially continuous adjustment of the positioner stroke length. Even finer resolution is obtainable if the number of notches 75 is increased or a finer thread 32 is employed.

While a preferred embodiment of the present invention has been described and illustrated for purposes of clarity and explanation, it will be understood that many changes and modifications and substitutions can be made to the described embodiment by those possessed of ordinary skill in the art without thereby departing from the scope and spirit of the present invention which is defined in the following claims. In particular, the threading along the inner sleeve 30 could be formed on the inside surface of the outer sleeve, with a corresponding displacement of the interior thread 68 to the outer surface of the ring 66, the tab 70 being eliminated from the outer surface. Still other similar modifications are possible which do not depart from the scope of the invention as defined in the following claims.

What is claimed is:

1. In a positioner of the type having a piston rod movable through a cylinder for adjusting the relative positions of elements attached to said rod and said cylinder respectively, the improvement comprising:

first stop means on said cylinder;

second stop means on said rod;

said stop means being configured for limiting the stroke of said rod through said cylinder between a fully extended position of said rod and stopping engagement between said stop means;

one of said stop means being axially movable relative to both said cylinder and said rod for adjusting the length of said stroke; and sleeve means coaxial with said rod, said sleeve means being rotatable for moving said one stop means;

means for releasably locking said sleeve means to said rod against rotation to thereby fix the length of said stroke;

said means for locking comprising detent means fixed to said rod and removable means normally urging said sleeve means into engagement with said detent means to normally lock said sleeve means against rotation.

2. A positioner with continuously adjustable stroke limiting, comprising:

a rod connected to a piston movable through a cylinder for adjusting the relative positions of elements attached to said rod and said cylinder respectively;

a first stop element movable with said cylinder;

a threaded inner sleeve coaxially fixed on said rod;

a threaded second stop element axially displaceable on said inner sleeve and configured to make axial interference with said first stop element; and a rotatable outer sleeve axially fixed to said rod and interlocked for moving said second stop element along said inner sleeve thereby to limit the stroke of said rod through said cylinder between a fully extended position of said rod and stopping engagement between said first and second stop elements.

3. The positioner of claim 2 further comprising means for locking said second sleeve against rotation to said rod to thereby also fix said second stop means against displacement along said inner sleeve thus fixing the length of said stroke.

4. The positioner of claim 3 wherein said means for locking comprise detent means fixed to said rod and means normally urging said outer sleeve into engagement with said detent means to normally lock said outer sleeve against rotation.

5. The positioner of claim 2 wherein said first stop element moves within said inner sleeve during said stroke and has one or more radial tabs extending through longitudinal slots in said inner sleeve, and said second stop element is a ring in threaded engagement with said inner sleeve such that said radial tabs are stopped against longitudinal displacement in said slots by said ring to make said stopping engagement.

6. A positioner with continuously adjustable stroke limiting, comprising:

a rod connected to a piston movable through a cylinder for adjusting the relative positions of structural elements attached to said rod and said cylinder respectively;

a first stop element moveable with said cylinder;

an inner sleeve coaxial to said rod and having an open end dimensioned to receive the diameter of said cylinder;

an outer sleeve rotatable with respect to said inner sleeve; and a second stop element axially displaceable responsive to relative rotation between said sleeves;

said first stop element being configured to make axially stopping engagement with said second stop element to limit travel of said cylinder into said inner sleeve at a point selectable by positioning of said second stop element along said sleeves thereby to limit the stroke of said rod through said cylinder.

7. The positioner of claim 1, wherein said first stop element has one or more radial projections, said inner sleeve has longitudinal slots terminating at said open end for receiving said radial projections for longitudinal movement, said radial projections extending to the exterior of said inner sleeve; and said second stop element comprises a ring about said inner sleeve dimensioned to stop movement of said tabs along said slots.

8. The positioner of claim 7 wherein said ring is threaded to said inner sleeve and circumferentially locked to said outer sleeve for repositioning said ring along said inner sleeve by rotation of said outer sleeve relative to said inner sleeve.

9. The positioner of claim 6 further comprising means for locking said sleeves against relative rotation to thereby fix said second stop means at a selected position along said sleeves thus fixing the length of said stroke.

10. The positioner of claim 6, wherein said means for locking comprise detent means fixed to said rod and means normally urging one of said sleeves into engagement with said detent means to lock said one sleeve against rotation.

11. A positioner with continuously adjustable stroke limiting, comprising:

a rod connected to a piston movable through a cylinder for adjusting the relative positions of structural elements attached to said rod and said cylinder respectively;

one or more radial projections movable with an end of said cylinder;

an inner sleeve axially fixed in coaxial relationship to said rod, said inner sleeve having an open end dimensioned to receive said cylinder end;

said inner sleeve having longitudinal slots terminating at said open end for receiving said radial projections for longitudinal movement of said cylinder end into said inner sleeve, said radial projections extending to the exterior of said inner sleeve;

an outer sleeve rotatable with respect to said inner sleeve; and a ring axially displaceable between said sleeves responsive to relative rotation between said sleeves;

said ring adapted to make axially stopping engagement with said radial projections to limit travel of said cylinder end into said inner sleeve at a point selectable by positioning of said ring along said sleeves thereby to limit the stroke of said rod through said cylinder.

12. The positioner of claim 11 wherein said ring is threaded to said inner sleeve and is circumferentially locked to said outer sleeve for repositioning said ring along said inner sleeve by rotation of said outer sleeve relative to said inner sleeve.

13. The positioner of claim 11 further comprising means for locking said sleeves against relative rotation to thereby fix said ring at a selected position along said sleeves thus fixing the length of said stroke.

14. The positioner of claim 13 wherein said means for locking comprise detent means fixed to said rod ad means urging one of said sleeves into engagement with said detent means to normally lock said sleeves against said relative rotation.

* * * * *